United States Patent [19]

Arakawa et al.

[11] Patent Number: 4,583,721

[45] Date of Patent: Apr. 22, 1986

[54] MOLTEN METAL DISCHARGING DEVICE

[75] Inventors: Kazumi Arakawa, Anjo; Masuo Sugie, Tokoname; Takashi Watanabe, Chiryu; Takumi Nishio, Toyota; Toshio Kawamura, Takahama; Tsutomu Nagahata, Osaka; Takashi Matsushita, Wakayama, all of Japan

[73] Assignee: Toshiba Ceramics Co., Ltd., Tokyo, Japan

[21] Appl. No.: 581,359

[22] Filed: Feb. 17, 1984

[30] Foreign Application Priority Data

Nov. 2, 1983 [JP] Japan ..... 58-206479

[51] Int. Cl.[4] ..... B22D 41/08

[52] U.S. Cl. ..... 266/220; 266/271; 222/603

[58] Field of Search ..... 266/236, 220, 275, 217; 222/600, 603

[56] References Cited

U.S. PATENT DOCUMENTS

| | | | |
|---|---|---|---|
| 2,943,370 | 7/1960 | Murarsheed | 222/600 |
| 3,136,834 | 6/1964 | Lorenz | 266/220 |
| 3,253,307 | 5/1966 | Griffiths | 266/220 |
| 3,337,329 | 8/1967 | Finkl | 266/236 |
| 3,430,644 | 3/1969 | Lyman | 222/600 |
| 3,454,201 | 7/1969 | Fichera | 266/220 |
| 3,465,810 | 9/1969 | Sylvester | 164/66 |
| 3,581,948 | 6/1971 | Detalle | 222/603 |
| 3,731,912 | 5/1973 | Kutzer | 266/236 |
| 3,773,226 | 11/1973 | Kutzer | 266/220 |
| 3,838,798 | 10/1974 | Voss | 266/236 |
| 4,091,971 | 5/1978 | Tinnes et al. | 222/603 |
| 4,179,046 | 12/1979 | Jeschke et al. | 222/603 |
| 4,253,647 | 3/1981 | Andres | 266/236 |
| 4,360,190 | 11/1982 | Ato | 266/220 |
| 4,365,731 | 12/1982 | Fehling et al. | 222/603 |
| 4,415,103 | 11/1983 | Shapland et al. | 222/603 |

FOREIGN PATENT DOCUMENTS

| | | | |
|---|---|---|---|
| 69895 | 12/1975 | Australia . | |
| 501931 | 3/1976 | Australia . | |
| 498438 | 6/1976 | Australia . | |
| 500687 | 7/1977 | Australia . | |
| 508437 | 10/1978 | Australia . | |
| 6856/81 | 3/1981 | Australia . | |
| 1938117 | 12/1975 | Fed. Rep. of Germany . | |
| 808711 | 4/1937 | France . | |
| 1270625 | 7/1961 | France . | |
| 2053179 | 7/1969 | France . | |
| 54-21533 | 7/1979 | Japan . | |
| 341949 | 12/1959 | Switzerland . | |
| 834234 | 5/1960 | United Kingdom . | |
| 1322375 | 7/1973 | United Kingdom . | |
| 2094454 | 9/1982 | United Kingdom | 266/236 |

*Primary Examiner*—L. Dewayne Rutledge
*Assistant Examiner*—S. Kastler
*Attorney, Agent, or Firm*—Oblon, Fisher, Spivak, McClelland & Maier

[57] ABSTRACT

A molten metal discharging device including a stationary plate of refractory material and adapted to be mounted at a bottom portion of a container for accommodating molten metal, the stationary plate having a molten metal passage bore for permitting the molten metal from the container to be discharged therethrough, and a slide plate of refractory material slidable along a lower face of the stationary plate and adapted to open or close the passage bore by being slidably displaced relative to the stationary plate, wherein the stationary plate includes a stationary plate main body having the passage bore therein, at least a major part of the main body being made of porous refractory material, the stationary plate main body having a chamber around a circumferential wall part of the passage bore and a gas introduction hole communicated with the chamber for introducing a gas from outside into the chamber, the circumferential wall part having gas supply hole elements for supplying the gas therethrough from the chamber to the passage bore enables to reduce the heat dissipation through the stationary plate and to thereby reduce the risk of clogging of the molten metal passage bore in the stationary plate due to the solidification of the molten metal or the like.

26 Claims, 4 Drawing Figures

MOLTEN METAL DISCHARGING DEVICE

BACKGROUND OF THE INVENTION

This invention relates to U.S. Pat. application Ser. No. 581,510 filed Feb. 17, 1984 and concerns a molten metal discharging device adapted to be mounted at a bottom portion of a container such as a ladle or tundish so as to control the discharge of the molten metal in the casting of molten metal or the like.

In the case of casting molten steel, for instance, by way of a conventional continuous casting process, a molten metal discharging device comprising a stationary plate and a slide plate is attached to the bottom portion or a ladle of tundish accommodating the molten steel and the flow rate of the molten steel is adjusted by causing the slide plate to move slidably with respect to the stationary plate thereby opening or closing a passage bore, in the stationary plate, for the molten steel. In the above-mentioned molten metal discharging device, an inert gas such as argon is introduced from the stationary plate into the molten steel so as to prevent the clogging in the passage bore caused by the solidification of the molten steels and/or deposition of oxides of metal or metalloid such as Al, Ti, Ca, Cr, Mn, Si or Ni.

The conventional molten metal discharging device of the type described above is shown in FIG. 1.

In FIG. 1, an upper nozzle 1 having a molten metal passage bore 1*a* is secured to a bottom portion of a tundish (not illustrated). Below the upper nozzle 1 is attached a molten metal discharging device 14 comprising an upper stationary plate 2, a slide plate 3 and a lower stationary plate 4 having molten metal passage bores 2*a* 3*a*, 4*a* respectively. The slide plate 3 moves slidably between the upper stationary plate 2 and the lower stationary plate 4 in the direction of A or B to open or close the passage bore 2*a*, 3*a*, 4*a* thereby adjusting the flow rate of the molten steel passing through the bores 2*a*, 3*a*, 4*a* and completely closing the bores 2*a*, 3*a*, 4*a*. The frame member 2*b* of the upper stationary plate 2 is made of dense refractory material and an annular, porous gas supply member 5 made of porous refractory material is tightly fitted over the entire circumference of the upper and enlarged inner circumferential wall surface 2*c* of the frame member 2*b* so as to define the passage bore 2*a*. A gas pressure-uniformalizing zone or uniform pressure zone 6 in the form of an annular space or chamber is defined between the annular porous member 5 and the frame member 2*b* of the upper stationary plate 2. Further, a gas introduction hole 7 communicated with the uniform pressure zone 6 is formed in the upper stationary plate 2, and a gas introduction pipe (not shown) is connected to the gas introduction hole 7. A submerged nozzle 8 is attached to the bottom of the lower stationary plate 4 and inserted at the lower part thereof into a mold 9. A metal member 15 constituting a part of the tundish is secured by means of cement mortar, for instance, to the upper stationary plate 2 of the molten metal discharging device 14.

In the illustrated device 14, molten steel poured from a tundish (not illustrated) is supplied through the passage bores 1*a*, 2*a*, 3*a*, 4*a* and 8*a* formed respectively in the upper nozzle 1, the upper stationary plate 2, the slide plate 3, the lower stationary plate 4 and the submerged nozzle 8 into the mold 9 and then cooled within and below the mold 8. As the result, a molten layer 10, a partially- or semi-molten layer 11 and a solidified layer 12 are formed within and after or below the mold 9.

Mold powder layer 13 is provided above the molten layer 10.

In the molten metal discharging device 14 as described above, a gas is introduced from the gas introduction hole 7 into the molten steel through the gas supply member 5 to agitate the molten steel when the molten steel is started to be poured from the ladle to the tundish, thereby preventing the solidification of the molten steel within the passage bore 2*a* in the upper stationary plate 2 and facilitating the initial opening of the bore 2*a*. Further, the gas is introduced through the porous gas supply member 5 to agitate the molten steel also during casting for preventing the solidification of the molten steel and/or deposition of metal oxides to thereby prevent clogging in the bore 2*a*, etc. Furthermore, the supply of the gas serves the oxides or impurities in the molten steel to float up and to reduce the content of the oxides or impurities incorporated in the steels to 1/5–1/10 as compared with those steel products obtained without such gas supply.

However, the conventional molten metal discharging device 14 as described above has the following drawbacks:

Since only the gas introduction member 5 is made of porous refractory material and the frame member 2*b* is made of dense refractory material in the upper stationary plate 2, the stationary plate 2 has no sufficient heat-insulating property. As a result, there is fear that the metal member 15 covering the molten metal discharging device 14 may be distorted. Further, since the frame member 2*b* made of dense refractory material is a relatively good heat conductor through which the heat can be removed from the molten steel, clogging in the passage bore 2*a* caused by the solidification of molten steels or the like cannot be effectively avoided.

SUMMARY OF THE INVENTION

This invention has been made in view of the above-mentioned problems and the object thereof is to provide a molten metal discharging device enabling a reduction of heat dissipation through the stationary plate and to thereby reduce the risk of clogging of the molten metal passage bore in the stationary plate.

The foregoing object can be attained in a molten metal discharging device according to this invention comprising:

a stationary plate of refractory material and adapted to be mounted at a bottom portion of a container for accommodating molten metal, the stationary plate having a molten metal passage bore for permitting the molten metal from the container to be discharged therethrough, and a slide plate of refractory material slidable along a lower face of the stationary plate and adapted to open or close the passage bore by being slidably displaced relative to the stationary plate, in which the stationary plate comprises a stationary plate main body having the passage bore therein, at least a major part of the main body being made of porous refractory material, the stationary plate main body having a chamber around a circumferential wall part of the passage bore and a gas introduction hole communicated with the chamber for introducing a gas from outside into the chamber, the circumferential wall part having gas supply hole means for supplying the gas therethrough from the chamber to the passage bore.

In the molten metal discharging device according to this invention, since the major part of the stationary plate main body having a molten metal passage bore is made of porous refractory material, the amount of heat conducted through the major part of the stationary plate main body can be kept relatively small and the heat dissipation through the stationary plate can be kept at a relatively lower level, whereby the lowering or decrease in the temperature of the molten metal, if any, in the molten metal passage bore of the stationary plate is made relatively insignificant and, accordingly, there is less fear of clogging in the passage bore caused by the solidification of the molten metal in the molten metal passage bore and/or the deposition of impurities in the molten metal (to be cast for example) to the wall of the passage bore.

In this specification, the terms "stationary plate main body", "major part of stationary plate main body" and "frame or frame part of the stationary plate" mean those portions occupying a major or dominant part of the stationary plate.

The term "dense refractory material" means those refractory materials which are produced to such a high density as to substantially prevent the gas from permeating therethrough (i.e. gas impermeable) and, the term "porous refractory material" means those refractory materials which are produced so as to have pores substantially allowing the gas to permeate therethrough (i.e. are gas permeable), and which have a relatively low heat conductivity and a relatively high heat insulating property as compared with the dense refractory material of the same composition.

The porous refractory material is selected, in view of the heat-insulating property and gas permeating property, etc., from those porous refractory materials to have appropriate composition and porosity etc. depending on the function of the member formed by the porous refractory material. In the case where it is not necessary to flow a gas through the porous refractory material, a number of pores present in the porous refractory material need not be in communication with each other or opened at a surface of the member.

The refractory materials for use in the stationary plates and the slide plate may preferably be highly corrosion-resistant materials such as high alumina refractories, magnesia refractories zircon refractories, or zirconia refractories.

The gas for use in the molten metal discharging device according to this invention, preferably, includes those gases such as argon or nitrogen gases which are inert to the molten metal. The inert gas may be preheated or not.

In the molten metal discharging device according to this invention, preferably, the stationary plate has a dense refractory material part secured to a lower face of the stationary plate main body, and the stationary plate is adapted to be in sliding contact with an upper face of the slide plate at a lower face of the dense material part.

In one preferred embodiment of the molten metal discharging device according to this invention, the main body of the stationary plate is integrally molded. In this embodiment, the gas supply hole means may comprise either a plurality of gas supply holes formed in the circumferential wall part of the stationary plate main body so as to communicate the chamber with the passage bore or pores present in porous refractory material constituting the circumferential wall part situated between the chamber and a circumferential surface of the passage bore. Further, the gas supply hole means may comprise both of them.

In the case where the gas supply hole means comprises gas supply holes formed in the circumferential wall part of the bore, each of the gas supply holes may be in any desired configuration in its lateral cross section such as an elongated or slit-like shape, as well as a circular, elliptical, and square or other polygonal shapes.

In another preferred embodiment of the molten metal discharging device according to this invention, the stationary plate main body comprises a gas supply member for allowing a supply of the gas therethrough into the passage bore, the gas supply member constituting at least a part of the circumferential wall part of the passage bore, and a frame part made of porous refractory material to which the gas supply member made of porous refractory material is tightly fitted, the chamber being defined between the frame part and the gas supply member. In this modified embodiment, the gas supply hole means may comprise a plurality of gas supply holes formed in the gas supply member made of dense or porous refractory material for communicating the chamber with the passage bore, and/or pores present in the gas supply member made of porous refractory material.

In the case where the gas supply hole means comprises a plurality of gas supply holes formed in the gas supply member, each of the gas supply holes may be of any desired configuration, in its lateral cross section, such as an elongated or slit-like shape, as well as circular, elliptical, and square or other polygonal shapes.

In the case where the gas supply hole means comprises the gas supply holes in the molten metal discharging device according to this invention, the chamber for supplying the gas from the gas introduction hole to the gas supply holes substantially at a uniform pressure may be disposed either entirely or partially around the circumferential wall part of the molten metal passage bore. For instance, the chamber may be disposed only on one side around the circumferential wall part of the bore from which the bore is started to be closed by the slide plate when the slide plate is moved to close the bore. In this case the gas supply holes may preferably be formed only on the one side of the circumferential wall part.

In the molten metal discharging device according to this invention, the stationary plate main body is preferably covered with gas-leak preventive means so as to prevent a gas from leaking through an outer surface of the main body. A coating may be applied, for instance, as the gas-leak preventive means, but other means such as glazing may be used.

BRIEF DESCRIPTION OF THE DRAWINGS

This invention is to be described in more detail referring to the accompanying drawings, by which the foregoing and other objects, as well as the features of this invention will be made clearer, in which.

DESCRIPTION OF THE PREFERRED EMBODIMENT

A description will now be made of a first preferred embodiment of a molten metal discharging device 18 according to this invention referring to FIG. 2.

Figure 2:
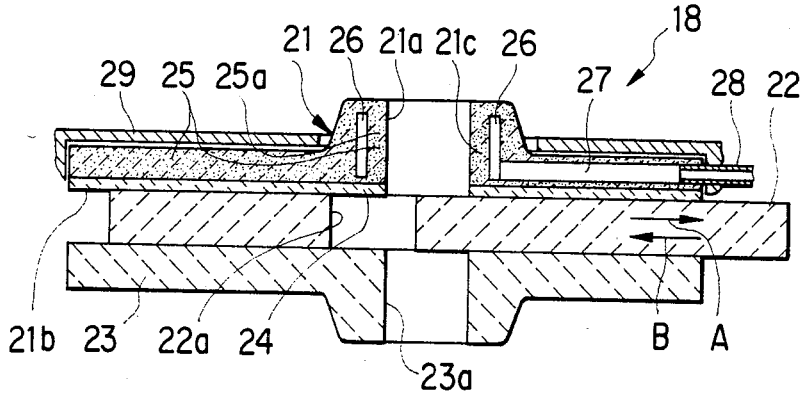
FIG. 2 is an explanatory cross sectional view of a first preferred embodiment of the molten metal discharging device according to this invention.
Figure 3:
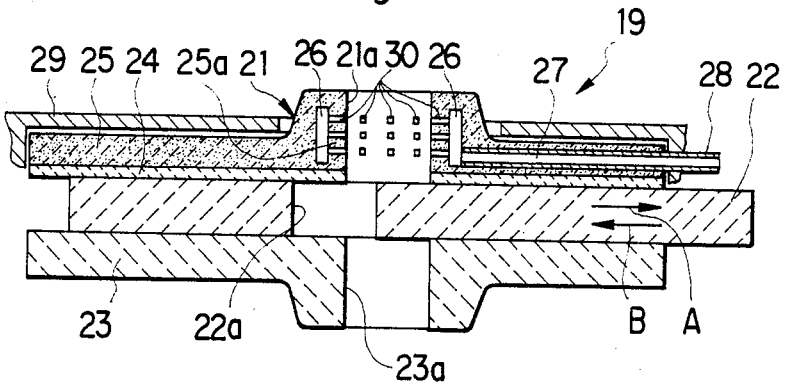
FIG. 3 is an explanatory cross sectional view of a second preferred embodiment of the molten metal discharging device according to this invention.

In FIG. 2, the molten metal discharging device 18 comprises an upper stationary plate 21, a slide plate 22 and a lower stationary plate 23 having molten metal passage bores 21*a*, 22*a* and 23*a* respectively. The slide plate 22 is slidingly displaced by means of a driving and displacing device such as a hydraulic cylinder or the like (not illustrated) in the direction A or B to open or close the passage bore 21*a*. The upper stationary plate 21 comprises a lower layer or part 24 made of dense refractory material situated on the side of the sliding face 21*b* of the plate 21 and a main body 25 made of porous refractory material situated thereabove, and the plate 21 is formed by integral molding of the main body 25 and the lower part 24. A gas pressure-uniformalizing zone or uniform pressure zone 26 in the form of an annular chamber having a cross section of 2 mm in width and 25 mm in height is formed to the inside around the circumferential wall part 25*a* of the main body 25, at a position spaced apart by 15 mm from the sliding face 21*b*. A gas introduction hole 27 in communication with the uniform pressure zone 26 is formed in the main body 25 made of porous refractory material, and a gas introduction pipe 28 made of iron or like other metal is connected to the introduction hole 27. The inserted end of the gas introduction pipe 28 may be extended near the chamber 26 as shown in FIG. 3. The gas introduction pipe 28 may be made of refractory material instead of metal. The upper stationary plate 21 is impregnated with tar, pitch or resin only at the lower part 24 made of dense refractory material situated on the side of the sliding face 21*b*, while the outer surface of the main body 25 made of porous refractory material is covered or coated with glazing so as to prevent the gas from escaping or leaking, that is, for providing a gastight seal. A metal member 29 constituting a part of the tundish is secured by means of cement mortar, for example, to the outer surface of the upper stationary plate 21 in the molten metal discharging device 18.

Figure 1:
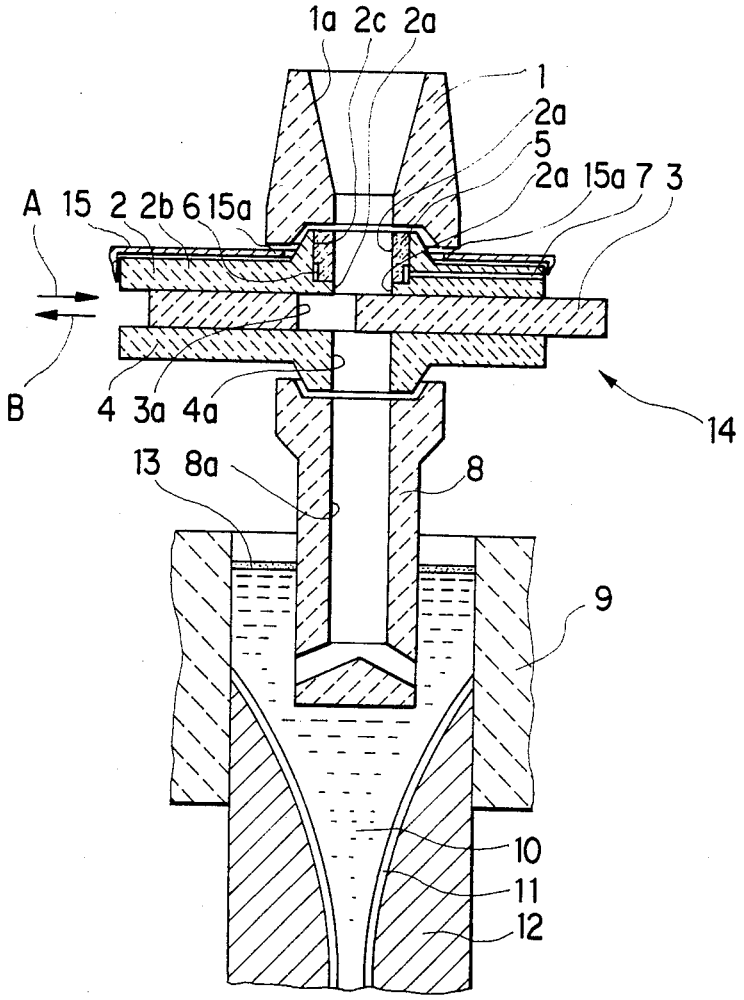
Fig. 1 PRIOR ART
FIG. 1 is an explanatory cross sectional view showing an example of a conventional molten metal discharging device applied between a tundish and a mold of a continuous casting apparatus.

In the same manner as the conventional molten metal discharging device 14 shown in FIG. 1, the molten metal discharging device 18 may be used, for instance, in the state where the upper stationary plate 21 is mounted, for instance, to the upper nozzle 1 at a bottom portion of the tundish and the lower stationary plate 23 is attached at the lower part thereof with the submerged nozzle 8.

The uniform pressure zone 26 situated in the upper stationary plate 21 were produced by embedding hard paper material having a shape corresponding to the zone 26 in the refractory-mixed body upon molding and then by burning out the same in the sintering or burning process. The gas introduction hole 27 was produced by drilling after sintering. The uniform pressure zone 26 and the gas introduction hole 27 may, of course, be produced or formed by any other appropriate method.

Each of the passage bore 21*a*, the chamber 26, etc. may be of an elliptic, polygonal or like other shape instead of circular shape in its lateral cross section.

As for the operation of the molten metal discharging device 18 constituted as described above, in a case where the device 18 is mounted, for instance, at the bottom of the tundish and when the molten steel is started to be poured from the ladle to the tundish, an inert gas is supplied from the gas introduction pipe 28 through the gas introduction hole 27, the pressure-uniformalizing zone 26 and the porous circumferential wall part 21*c* of the passage bore 21*a* to the inside of the passage bore 21*a* or into the molten steel, whereby the molten steel is agitated by the bubbles of the gas to prevent the solidification of the molten steel in the passage bore 21*a* in the upper stationary plate 21 and to facilitate the initial opening of the bore. Further, since the gas can be supplied to the passage bore 21*a* also during casting to agitate the molten steel, solidification of the molten steel and/or the deposition of the oxides can be prevented to thereby prevent to clogging of the passage bore 21*a*.

In addition, since the main body 25 occupying the major or dominant part of the upper stationary plate 21 is made of porous refractory material in the molten metal discharging device 18, the heat-insulating property around the passage bore 21*a* (or 2*a*) can be improved to prevent distortion in the metal member 29, as well as to reduce the risk of clogging of the passage bore 21*a* (or 2*a*) compared with the case of the molten metal discharging device 14 in which the frame member 2*b* of the upper stationary plate 2 is made of dense refractory material.

As shown in FIG. 3, slit-like holes 30 may be formed, as the gas supply hole means communicating the uniform pressure zone 26 in the form of an annular chamber with the molten metal passage bore 21*a*, in the circumferential wall part 25*a* of the main body 25 made of the porous refractory material to constitute a second preferred embodiment of a molten metal discharging device 19. Each of the gas supply holes 30 may be a small hole of circular, polygonal or other shape instead of the elongated shape such as a slit in its lateral cross section. When gas supply holes 30 much larger than the pores present in the porous refractory material of the main body 25 are utilized, the gas is supplied to the passage bore 21*a* in the form of bubbles of a larger diameter which have a greater agitating effect to the molten steels, and clogging to the passage bore 21*a* can be prevented more effectively.

In the molten metal discharging device 19, the cross-sectional area of each of the gas supply holes 30 is selected so as to be of a size small enough to prevent the intrusion of molten steel into the holes 30 by the pressure of the gas while, on the other hand, being large enough to produce bubbles in such a diameter capable of effectively agitating the molten steel.

In the molten metal discharging device 19 of the second preferred embodiment according to this invention shown in FIG. 3, the same components as those in the molten metal discharging device 18 shown in FIG. 2 have the same reference numerals. It will be apparent that the molten metal discharging device 19 can operate in the same manner as the device 18.

Although the inserted end of the gas introduction pipe 28 is extended near the uniform pressure zone 26 in the molten metal discharging device 19, the end of the gas introduction pipe 28 may be tightly fitted within the gas introduction hole 27 in the manner illustrated in FIG. 2.

Figure 4:
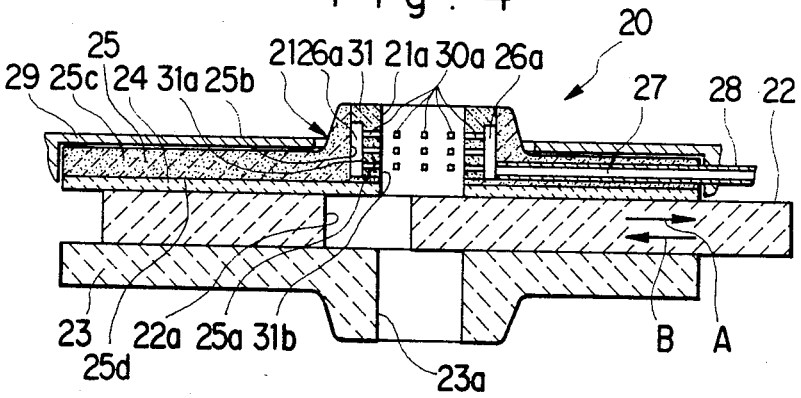
FIG. 4 is an explanatory cross sectional view of a third preferred embodiment of the molten metal discharging device according to this invention.

FIG. 4 shows a molten metal discharging device 20 as the third preferred embodiment according to this invention. In the device 20 of FIG. 4, the same components as those in the device 18 or 20 have the same reference numerals.

In the molten metal discharging device 20, an upper part or stationary plate main body 25 comprises a frame part 25c made of porous refractory material and an annular gas supply member 31 made of porous refractory material and having a plurality of gas supply holes 30a extended from the outer circumferential surface 31a to the inner circumferential surface 31b thereof. The gas supply member 31 is tightly fitted in a central recess 25b of the frame part or major part 25c of the main body 25 so as to constitute the circumferential wall part 25a of the passage bore 21a. The gas supply member 31 may be made of dense refractories instead or porous refractories. A uniform pressure zone 26a in the form of an annular space or chamber is defined between a gas supply member 31 and the frame part 25c. Each of the gas supply holes 30a which communicates the uniform pressure zone 26a with the passage bore 21a generally defined by the inner circumferential surface 31b of the porous refractory member 31 may be a small hole in the form of an elongated slit as the gas supply hole 30 shown in FIG. 3 or circular shape in its lateral cross section.

It will be apparent that the molten metal discharging device 20 shown in FIG. 4 can operate in the same manner as the device 19 shown in FIG. 3.

In the molten metal discharging device 20, the gas supply member 31 made of porous refractory material and the frame member 25c made of porous refractory material may be substantially identical or different with each other in view of their composition or porosity. For instance, the gas supply member 31 made of porous refractory material may have pores larger than those in the frame part 25c made of porous refractory material, or the porous refractory member 31 may be made of material having higher corrosion resistance than that of the frame part 25c. Furthermore, the central recess 25b in the frame member 25c may be formed as a penetrating hole which extends to the lower face 25d of the frame member 25c. In addition, the holes 31a may not be formed in the gas supply member 31a when the member 31a is made of porous refractories. In this case the gas can be supplied from the uniform pressure zone 26a to the passage bore 21a only through the pores present in the porous refractory member 31 as the gas supply hole means.

Although the foregoing descriptions have been made to a molten metal discharging device of a so-called 3-plate slide gate system, which comprises an upper stationary plate, a slide plate and a lower stationary plate, it is apparent that the molten metal discharging device according to this invention can also be constituted in the form of a so-called 2-plate slide gate system comprising a single stationary plate to be mounted for example to the upper nozzle of a tundish and a slide plate slidable relative to the single stationary plate, in which the slide plate is displaced integrally with a submerged nozzle or the like to be attached to the bottom thereof, by forming the single stationary plate in the same structure as that of the upper stationary plate in the foregoing embodiments. Furthermore, it is also apparent that the molten metal discharging device according to this invention can, of course, be mounted not only to the bottom of a tundish but also to the bottom of a ladle or the like.

EXAMPLE AND COMPARATIVE EXAMPLE

Two conventional molten metal discharging devices 14 and two molten metal discharging devices 18 (the gas introduction pipe 28 being inserted into the hole 27 near the uniform pressure zone 26) as the first embodiment according to this invention were connected respectively to four strands of a tundish having a capacity of 30 ton. More specifically, two conventional devices 14 were connected to two strands of upper nozzles at the bottom of the tundish, and two devices 18 were connected to the remaining two strands of upper nozzles at the bottom of the tundish respectively. Continuous casting was carried out while pouring aluminum-killed steels of 0.035% aluminium sol. continuously from a ladle having a capacity of 160 ton into the tundish. The following results were obtained.

At first, molten steel was poured from the ladle into the tundish while keeping the passage bores 2a, 21a of the molten metal discharging devices 14, 18 closed by the slide plates 3, 22 and blowing argon gas at a flow rate of 150 liter/min. into the passage bores 2a, 21a respectively. When the level of the molten steel in the tundish reached about 60 cm in height, the passage bores 2a, 21a of the molten metal discharging devices 14, 18 were opened and molten steel by the volume corresponding to the content in seven ladles were continuously cast while adjusting the flow rates of the argon gas to 10 liter/min respectively. Although the flow rates of the molten steel through the passage bores 2a, 21a to the mold 9 became insufficient for a predetermined casting rate in the course of the casting in each of the molten metal discharging devices 14, 18, both of the two conventional molten metal discharging devices 14 reached this unfavorable state before the devices 18 according to this invention reached the same state. This is considered to be attributable to the reason that the molten metal discharging devices 18 of a embodiment according to this invention are superior in the heat insulating property to the conventional molten metal discharging devices 14.

Although the part 15a of the metal member 15 near the passage bore 2a was distorted by about 1.5 mm after casting of steel for 100 ladles in each of the conventional molten metal discharging devices, the metal member 29 showed no such distortion at all in the molten metal discharging devices 18 of the embodiment according to this invention.

Obviously, numerous modifications and variations of the present invention are possible in light of the above teachings. It is therefore to be understood that within the scope of the appended claims, the invention may be practiced otherwise than as specifically described herein.

What is claimed is:

1. A slide gate device for controlling discharge of molten metal from a container accomodating the molten metal therein, comprising:

a stationary plate of refractory material adapted to be attached below a bottom portion of the container and having a molten metal passage bore formed therein for permitting the molten metal from the container to be discharged therethrough, and a slide plate of refractor material slidable along a lower face of the stationary plate and adapted to open or close the passage bore by being slidably displaced relative to the stationary plate, wherein the stationary further comprises a main body wherein a major voluminal proportion of the stationary refractory plate including substantially all of a circumferential wall part of the passage bore comprises porous gas permeable refractory materials, thereby enabling enhancing of a heat-insulating property of the stationary plate so as to avoid cooling the circumferential wall of the passage bore and thus avoid solidfication of the metal in the passage bore; and a thin layer of dense, substantially gas impermeable refractoy material secured to a lower face of the main body, a lower face of the thin layer constituting a lower face of the stationary plate and which is in sliding contact with an upper face of the slide plate.

2. The device according to claim 1, in which the main body includes a chamber formed around the circumferential wall part of the passage bore, and a gas introduction hole in communication with the chamber for introducing a gas from outside into the chamber, and wherein the circumferential wall part includes gas supply hole means for supplying the gas therethrough from the chamber to the passage bore.

3. The device according to claim 1, in which the main body is integrally molded.

4. The device according to claim 3, in which the gas supply hole means further comprises a plurality of gas supply holes formed in the circumferential wall part of the main body, the gas supply holes communicating the chamber with the passage bore.

5. The device according to claim 4, in which each of the gas supply holes is, in its lateral cross section, of an elongated shape.

6. The device according to claim 5, in which each of the gas supply holes is, in its lateral cross section, of a slit-like shape.

7. The device according to claim 4, in which each of the gas supply holes is, in a lateral cross section thereof, of a circular shape.

8. The device according to claim 3, in which the gas supply hole means further comprises a plurality of pores present in the porous refractory material constituting the circumferential wall part situated between the chamber and a circumferential face of the passage bore.

9. The device according to claim 2, in which the the main body further comprises a gas supply member for allowing supply of the gas therethrough into the passage bore, wherein the gas supply member further comprises at least a part of the circumferential wall part of the passage bore, and a frame part to which the gas supply member is tightly fitted, the frame part having said gas introduction hole formed therein, and the chamber being defined between the frame part and the gas supply hole means.

10. The device according claim 9, in which the gas supply hole means further comprises a plurality of gas supply holes formed in the gas supply member, the gas supply holes communicating the chamber with the passage bore.

11. The device according to claim 10, in which each of the gas supply holes in, in a lateral cross section thereof, of an elongated shape.

12. The device according to claim 11, in which each of the gas supply holes is, in a lateral cross section thereof, of a slit-like shape.

13. The device according to claim 10, in which each of the gas supply holes is, in a lateral cross section thereof, of a circular shape.

14. The device according to claim 9, in which the gas supply hole means further comprises a plurality of pores present in the gas supply member.

15. The device according to claim 1, in which the main body further comprises a coating of gas-leak preventive means so as to prevent a gas from leaking through an outer surface thereof.

16. The device according to claim 15, further comprising means for controlling the discharge of molten steel.

17. The device according to claim 16, in which the device comprises a two-plate slide gate system.

18. The device according to claim 16, in which the device comprises a three-plate slide gate system.

19. A slide gate device for controlling discharge of molten metal from a container accommodating the molten metal therein, comprising:

a stationary plate of refractory material adapted to be attached below a bottom portion of the container and having a molten metal passage bore therein for permitting the molten metal from the container to be discharged therethrough, and a slide plate of refractory material slidable along a lower face of the stationary plate and adapted to open or close the passage bore by being slidably displaced relative to the stationary plate wherein the stationary plate further comprises a main body having said passage bore formed therein, a chamber formed around a circumferential wall part of the passage bore and gas introduction hole in communication with the chamber for introducing a gas from an outside into the chamber, wherein the circumferential wall part includes gas supply hole means for supplying the gas therethrough from the chamber of the passage bore, and a frame part of gas permeable refractory material to which a gas supply member is tightly fitted, the frame part including said gas introduction hole formed therein and the chamber being defined between the frame part and the gas supply hole means, and a thin layer of dense, substantially gas impermeable refractory material secured to a lower face of the main body, a lower face of the thin layer constituting a lower face of the stationary plate and which is in sliding contact with an upper face of the slide plate.

20. The device according to claim 19, in which each of the gas supply holes is, in a lateral cross section thereof, of an elongated shape.

21. The device according to claim 20, in which each of the gas supply holes is, in a lateral cross section thereof, of a slit-like shape.

22. the device according to claim 19, in which each of the gas supply holes is, in a lateral cross section thereof, of a circular shape.

23. The device according to claim 19, in which the main body further comprises a coating of gas-leak preventive means so as to prevent a gas from leaking through an outer surface thereof.

24. The device according to claim 23, which further comprises means for controlling the discharge of molten steel.

25. The device according to claim 24, in which the device comprises a two-plate slide gate system.

26. The device according to claim 24, in which the device comprises a three-plate slide gate system.

* * * * *